United States Patent [19]

Schuyler

[11] Patent Number: 4,916,876

[45] Date of Patent: Apr. 17, 1990

[54] GLASS BLOCK WALL CONSTRUCTION

[76] Inventor: Stephen V. C. Schuyler, 5515 Randolph Rd., Rockville, Md. 20852

[21] Appl. No.: 207,612

[22] Filed: Jun. 3, 1988

[51] Int. Cl.[4] ..... E04C 1/42

[52] U.S. Cl. ..... 52/308

[58] Field of Search ..... 52/308, 307, 306, 241, 52/238, 477, 126.3

[56] References Cited

U.S. PATENT DOCUMENTS

| | | | |
|---|---|---|---|
| 479,433 | 7/1892 | Lee | 52/456 |
| 586,218 | 7/1897 | Basquin | 52/456 |
| 586,227 | 7/1897 | Belcher | 52/456 |
| 1,717,740 | 6/1929 | Simon | 52/238.1 |
| 2,140,999 | 12/1938 | Hohl | 52/477 |
| 2,248,671 | 7/1941 | Hohl | 52/241 |
| 2,318,362 | 7/1942 | Boeglen et al. | 52/308 |
| 2,326,245 | 10/1940 | Nichols et al. | 52/126.3 |
| 2,346,170 | 4/1944 | Kalkusch | 52/308 |
| 3,566,561 | 10/1968 | Tozer | 52/280 |
| 3,603,054 | 9/1971 | Didry | 52/280 |
| 4,672,785 | 6/1987 | Salvo | 52/241 |

*Primary Examiner*—David A. Scherbel
*Assistant Examiner*—Michele A. Van Patten
*Attorney, Agent, or Firm*—Mason, Fenwick & Lawrence

[57] ABSTRACT

A glass block wall is provided, and includes rows of glass blocks without mortar, mastic or grout. The blocks rest upon horizontal strips of simple, readily made shape, such as channels and I-sections, and are separated by vertical strips of I-section, preferably having their webs slightly longer than their flanges. A perimeter frame is provided, at least parts of which are secured to the floor and a wall defining the opening for the glass block wall. Wedges are provided at the end of each row of glass blocks as required to accommodate the variation in the size of individual glass blocks from the normal or established size. Corner elements are provided.

10 Claims, 2 Drawing Sheets

GLASS BLOCK WALL CONSTRUCTION

BACKGROUND OF THE INVENTION

The present invention relates to the construction of a wall including, for example, glass blocks and separator strips.

Walls, both interior and exterior, are typically made of elements, such as stone, bricks, and blocks of cinder or glass. These wall elements are typically laid up with a hardenable material between the individual elements, such hardenable material being, for example, mortar, cement, or grout. These materials have in common that they are moldable at room temperature or ambient temperature and become hard and rigid after being put in place. These materials are typically made from mixtures of dry materials and a liquid such as water, which are mixed as needed to make the moldable cement, mortar or grout, the stone, bricks or blocks being laid upon a bed of such material, with the ends and top and bottom in engagement with a layer of such material. In some cases, grouting material, which is extrudable or moldable at room temperature or ambient temperature, is used, but usually for waterproofing, rather than as a load-bearing component of the erected wall.

Glass blocks have been used as components of walls in more recent times, glass blocks having gained substantial popularity and comparatively extensive use in the fourth and fifth decades of the Twentieth Century. Glass blocks were used as components of walls for either decorative purposes, or to permit the passage of light therethrough, or both. Typically, glass block walls were constructed using mortar, but glass blocks not requiring mortar have been suggested.

Hohl 2,141,000 discloses a wall which is made of glass blocks, and without mortar, grout, cement or other material which is moldable at room temperature or ambient temperature and which becomes hardened. The glass blocks are separated by elongate plates or strips which extend horizontally between rows, being of substantial length: vertical strips extend between adjacent blocks in a row, and between the separator strips at the top and bottom of each row. The strips have webs which are provided at their sides with flanges having curved surfaces which match the curvature of the shoulders of the glass blocks. These flanges are somewhat bell-shaped in cross-section, and when the wall is viewed in elevation, the end faces of the flanges occupy substantially the same space which would be occupied by conventional mortar. The strips are extruded metal, or may be of formed sheet metal. The strips which extend horizontally have tongues at their ends, which extend through openings in vertical side strips, and are held by nails which extend through the holes in these tongues. As a consequence, the distance between the vertical strips at each side of the wall is a predetermined, fixed distance, and the construction inherently assumes a constant, unvarying size of the blocks used, whereas in fact the glass blocks exhibit some small but significant variation in size from the norm; this variation is not accommodated by the construction of Hohl 2,141,000. This construction entails some difficulty in assembling the horizontal strips to the vertical side strips, since only a narrow space is provided, between the strips and the space or opening in which the glass block wall is constructed for the insertion of the nails.

Further, the construction requires a facing strip to cover the extending tongues and holding nails.

There has been suggested, in addition, in Nichols 2,326,245 a similar construction, in which a wall of glass blocks and strips as shown in Hohl 2,141,000 is provided in panels, each panel comprising a perimeter frame, in addition to the rows of glass blocks with the horizontal and vertical separator strips.

SUMMARY OF THE INVENTION

The present invention is directed to a wall made of blocks, such as glass blocks, and of separator strips of solid material, such as metal, wood or plastic, such material being substantially rigid and non-moldable at ambient and room temperature. The separator strips comprise webs having flanges at their sides, the flanges having inner surfaces which are in spaced, parallel relationship, and which are substantially perpendicular to the web. These inner surfaces adjoin a portion of the side faces of each of said glass blocks, so that a perimeter portion of each of the side faces is covered and concealed by the flanges of the horizontal separator strips. Vertical separator strips of substantially the same cross-sectional shape are provided, the inner surfaces of the flanges of the vertical strips adjoining a marginal portion of the faces of the adjacent blocks, and the flanges of the horizontal and vertical strips adjoin portions of the faces of the glass blocks. The vertical separator strips which are provided between adjacent glass blocks in a row have their webs of slightly greater length than the flanges, so that an extension of the webs of the vertical separator strips extend into the channel provided between the flanges of the horizontal separator strips, the ends of the flanges of the vertical separator strips engaging the flanges of the horizontal separator strips.

A shim or shims is provided at one or both ends of each row as needed in order to provide for firm engagement of the vertical separator strips and blocks in a row, so as to provide rigidity to the wall: these shims or other means for forcing the blocks and vertical separator strips together accommodate the variations in the sizes of the glass blocks from the norm. Side strips are provided of simple channel shaped configuration, with the flanges thereof adjoining the faces of the adjacent glass blocks, and with the webs secured to a wall and to the floor which together partly define the opening in which the glass wall is constructed.

Among the objects of the present invention are to provide a glass block wall construction made without settable material and which provides a rigid and secure wall.

Another object of the present invention is to provide a glass block wall construction having enhanced appearance.

Still another object of the present invention is to provide a glass wall construction in which the appearance thereof is enhanced by a partial covering of the faces of glass blocks by flanges of separator strips used in the construction of the wall.

Still another object of the present invention is to provide a mortarless glass block wall which is rigid and secure against dislocation under conventional forces.

A still further objection of the present invention is to provide a glass block wall in which accommodation is provided for the variation in size of the glass blocks from the norm.

Still another object of the present invention is to provide a glass block wall of the mortarless type in which separator strips of inexpensive construction are provided.

Yet another object of the present invention is the provision of a glass block wall which may be readily assembled and disassembled by unskilled persons.

Other objects and many of the attendant advantages of the present invention will be readily understood from consideration of the following specification, claims and drawings.

DESCRIPTION OF THE PREFERRED EMBODIMENTS

Figure 1:
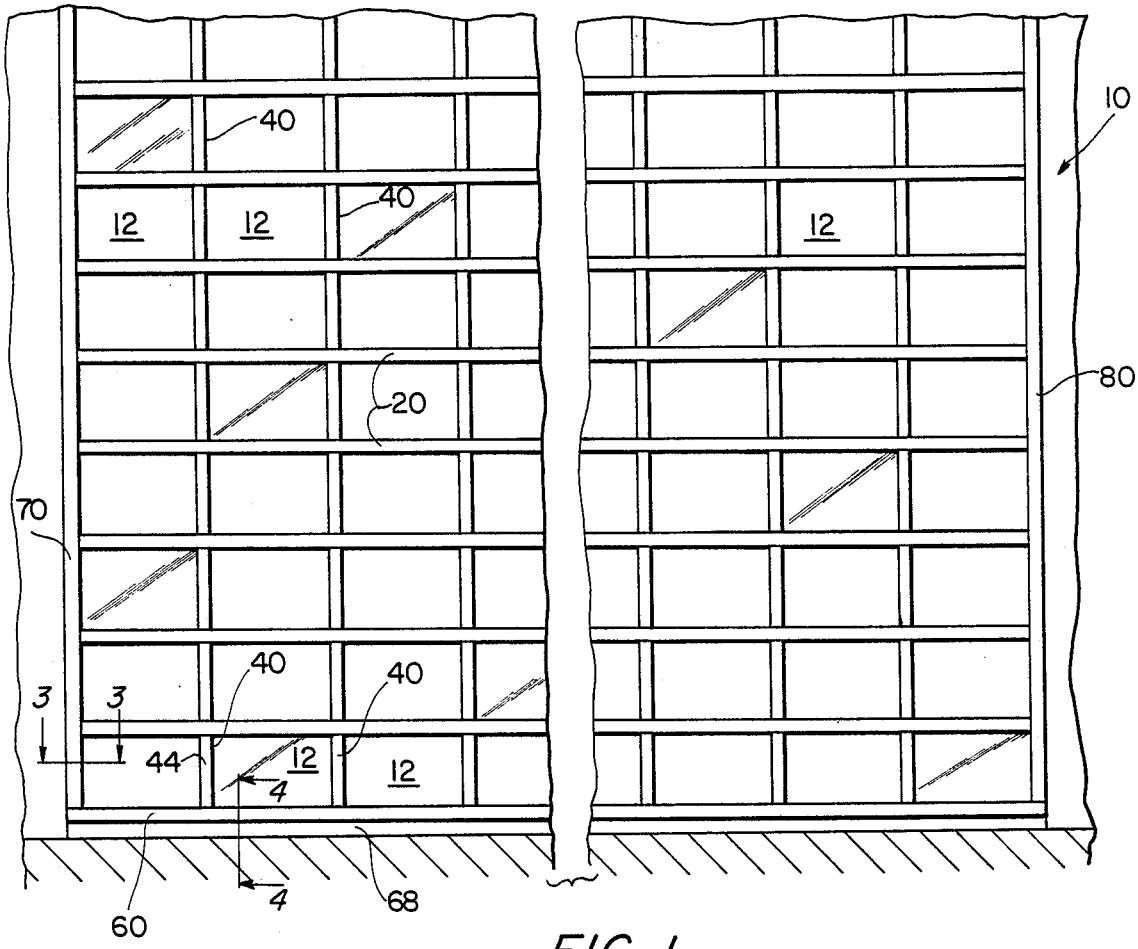
FIG. 1 is an elevational view, with parts broken away, of a portion of a glass block wall in accordance with the portion.

Referring now to the drawings, wherein like or corresponding reference numerals are used for like or corresponding parts throughout the several views, there is shown in FIG. 1 a glass block wall 10 in accordance with the present invention. Other block material may be used instead of glass. Glass block wall 10 is constructed without mortar, cement or grout, or other material of similar nature which is normally moldable or pliant at ambient temperature and which sets or hardens into a rigid state after it has been applied. As disclosed herein, glass block wall 10 is made without putty, mastic or other non-load bearing material which is used for the prevention of entry of water, since as shown the glass block wall construction is for interior use. As will be understood, however, when used for exterior purposes, such materials may be used.

The glass block wall 10 comprises rows of conventional glass blocks 12 having two substantially parallel faces, each nominally square, and four edges substantially transverse to them. Such glass blocks are made in standard or normal sizes, such as 6"×6", 8"×8", 9½"×9 ½", and 12"×12". These are the normal size designations, although these are not the actual or intended normal dimensions of the glass blocks. For example, each of the edges of the 8"×8" glass block is actually a nominal 7¾" long. The widths of the edges of the glass blocks are standardized; the 6" size block has a width of 3⅛" (approximately) and 8" size block has a width of 3 ⅞" approximately. It has been found that while the glass blocks have a normal or standard size, for example, 7¾" for the 8"×8" block, in actuality the size of the glass blocks of a particular nominal size actually vary, and a particular block may depart by about 1/16" from the normal or designated size. As a consequence, a row of just ten glass blocks may vary from the normal in horizontal extent of something over ½" if all of the blocks in that row happen to be undersized, as is possible.

Referring again to FIG. 1, between each row of the blocks 12 are horizontal separator strips 20, and between the glass blocks 12 in a row are vertical separator strips 40. A bottom base strip 60 is provided, and a pair of side strips 70 and 80 are also provided. A top strip (not shown) may be provided for the top of the glass wall construction 10 and may be a simple strip of rectangular cross-section to which a facing strip or flange may be nailed, after assembly, or may be a strip like the strip 60.

Figure 2:
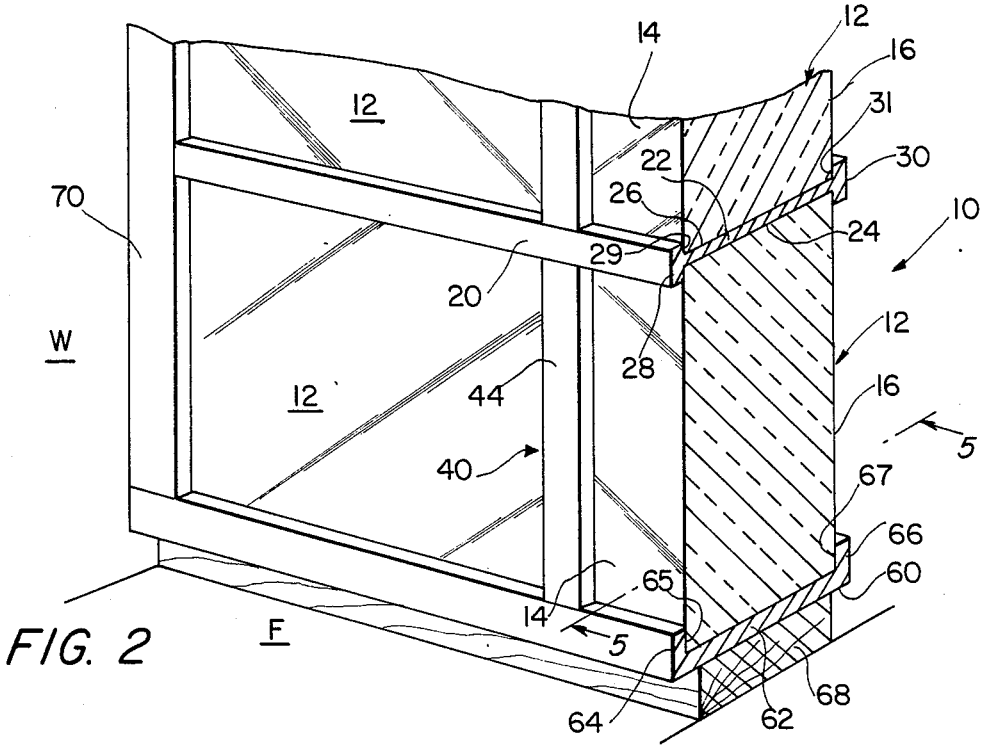
FIG. 2. is a perspective view, with parts broken away, of a portion of a glass block wall in accordance with the present invention.

Referring to FIG. 2, there is shown a lower corner of the glass block wall 10, including the bottom base strip 60, which comprises a web 62 with flanges 64 and 66 at the sides thereof, these flanges having inner faces 65 and 67, respectively, which are spaced apart, are substantially parallel, and are substantially perpendicular to the plane of the web 62., The inner surfaces 65 and 67 adjoin the marginal portions 14' and 16' of the faces 14 and 16 of glass block 12: by adjoining these portions of the faces 14 and 16, these inner surfaces 65 and 67 are either adjacent to or in contact with these portions of these faces. The bottom strip 60 is mounted upon and secured to a spacer strip 68 which is secured to the floor F. The spacer strip 68 is shown extending to a wall W which, together with the floor F, partly define the opening into which the glass block wall 10 is constructed.

Extending above the first row of glass blocks 12 is the horizontal separator strip 20 which comprises a web 22 of generally rectangular shape, having a lower planar surface 24 and an upper planar surface 26, these surfaces being substantially parallel. At the sides of the web 22, there are provided a pair of flanges 28 and 30, having inner faces 29 and 31 which are parallel, and substantially perpendicular to the web 22. The inner faces 29 and 31 adjoin the glass block 12 above the flange 22 in the same manner as the inner faces 65 and 67 of the flanges 64 and 66. The flanges 28 and 30 extend over the lower marginal portions of the faces 14 and 16 of the glass block 12, the flanges 28 and 30 having a height substantially above the upper surface of web 22, and therefore of the bottom edge of the glass block 12. The flanges 28 and 30 also extend downwardly a substantial distance, covering the upper marginal portions of the side faces 14 and 16 of the glass block 12 beneath the separator strip 20.

Figure 3:
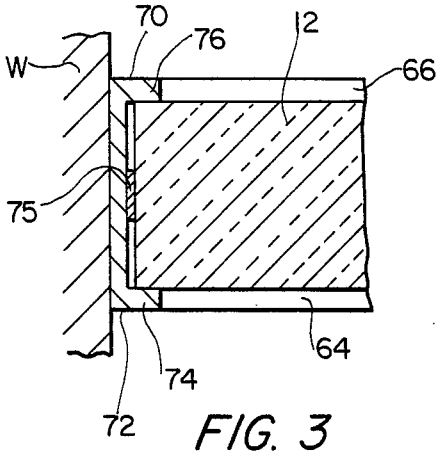
FIG. 3 is a cross-sectional view taken on the line 3—3 of FIG. 1.

In FIG. 3, there is shown the wall W, adjacent to which is the side strip 70, which is comprised of a web 72 and flanges 74 and 76. Side strip 70 may be secured in known manner to the wall W. There is also shown in FIG. 3 the glass block 12 which is in the lower corner of the glass block wall 10, and the flanges 64 and 66 of the bottom base strip 60. A shim 75 is shown in position between the end of the glass block 12 and the web 72 of the side strip 70. The shim 75 is placed in position after the entire bottom row of blocks 12 see FIG. 1) is placed in position, extending between the side strips 70 and 80, and after the vertical separator strips 40 have been put in place. As will be apparent, construction of the glass block wall 10 will begin with the securing in position of the bottom base strip 60 and the side strips 70 and 80, and the bottom spacer 68, if used. Then the bottom row of glass blocks is put in position by placing, alternately, glass blocks 12 and vertical separator strips 40 until the bottom row of glass blocks is complete. After that, a shim or shims 75, of the size required, is utilized, preferably at the end of the row of glass blocks 12, in order to accommodate any differences in the actual sizes of the glass blocks 12 forming the bottom row.

Figure 4:
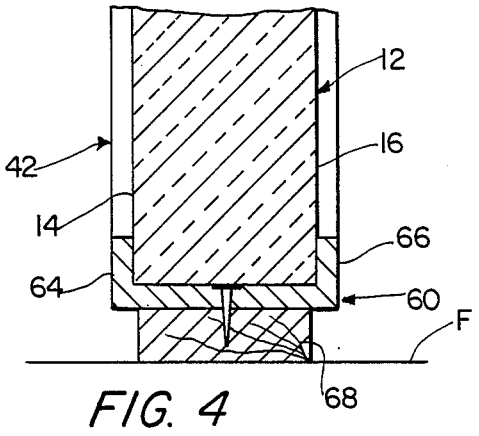
FIG. 4 is a cross-sectional view taken on the line 4—4 of FIG. 1.

FIG. 4 shows the corner glass block 12, a vertical separator strip 40, the bottom base strip 60, and the spacer 68, the latter in place on the floor F. As shown, the bottom base strip 60 is secured by a nail to the spacer strip 68. Also, the flanges 64 and 66 will be seen in adjoining relationship to the lower margins of the faces 14 and 16 of glass block 12, and extending over a substantial part of those faces.

Figure 5:
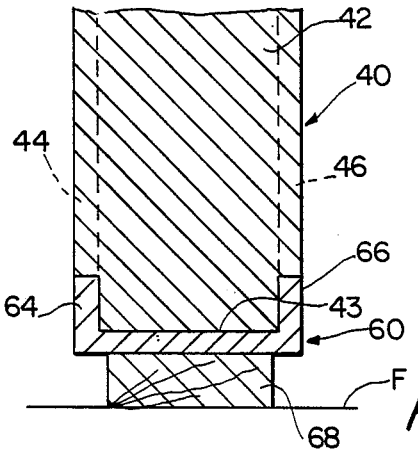
FIG. 5 is a cross-sectional view taken on the line 5—5 of FIG. 2.

In FIG. 5, there is shown a portion of a vertical separator strip 40, the bottom base strip 60, and the spacer strip 68 on the floor F. Spacer strip 40 is not longer than the edge of a glass block 12, and has substantially the same size and substantially the same cross-sectional shape as the horizontal spacer strip 20: it has a web 22 at the sides of which, as indicated by the dashed lines, are a pair of flanges 44 and 46 which adjoin marginal portions of glass blocks 12 in the same manner as the flanges of the horizontal separator strip 20. The flanges 44 and 46 have a lesser extent in the longitudinal direction than does the web 42, extending to the top surface of flanges 64 and 66. The web 42 has an extension 43 which extends into the space between the flanges 64 and 66 of the bottom base strip 60. The upper end of the separator strip 40 is of identical configuration, having an extension of the web 42 beyond the flanges 44 and 46, so as to extend into the space between the flanges 28 and 30 of the horizontal separator strip 20 above the two glass blocks 12 which are on either side of the vertical separator strip 40. The provision of the extension 43 assists in the assemblage of the glass block wall 10, providing guidance and support for the various elements as they are being assembled. As shown in FIGS. 1 and 2, the upper and lower ends of the flanges 44 of vertical separator strips 40 substantially engage the flanges of the horizontal separator strips 20.

The provision of the various flanges on the bottom base strip 60, the side strips 70 and 80, the horizontal separator strips 20 and the vertical separator strips 40, provides a distinctive and attractive appearance, the strips significantly contributing to the appearance of the glass block wall 10 by covering marginal portions of the faces 14 and 16 each glass block. The various strips may be made of wood, which may be colored so as to coordinate or contrast with the decor of the room, or may be of plastic or even metal, of any desired color and/or surface ornamentation. In addition, the flanges, since they adjoin the glass blocks, hold them securely in position against movement. The various shims 75, used as necessary in each row, provides for a locking engagement of the glass blocks and separator strips in each row. Thus, each row is securely locked, and the rows in vertical array are securely locked so that there results a glass block wall which is of rigid construction, being durable and not subject to inadvertent disassembly. The glass block wall 10 is constructed so as to accommodate actual size variations between glass blocks of the same nominal size, so that a secure and attractive glass block wall may be erected in accordance with the present invention, by unskilled persons. The glass block wall 10 may be readily disassembled, if desired.

The various strips are of an inexpensive construction. For example, they may be readily manufactured from wood, or from plastic, and may also be manufactured from metal. Consequently, because of the simple cross-sectional configurations of all of the strips and because of the regularity thereof, even of the vertical separator strips 40, these strips are inexpensive to produce.

Figure 6:
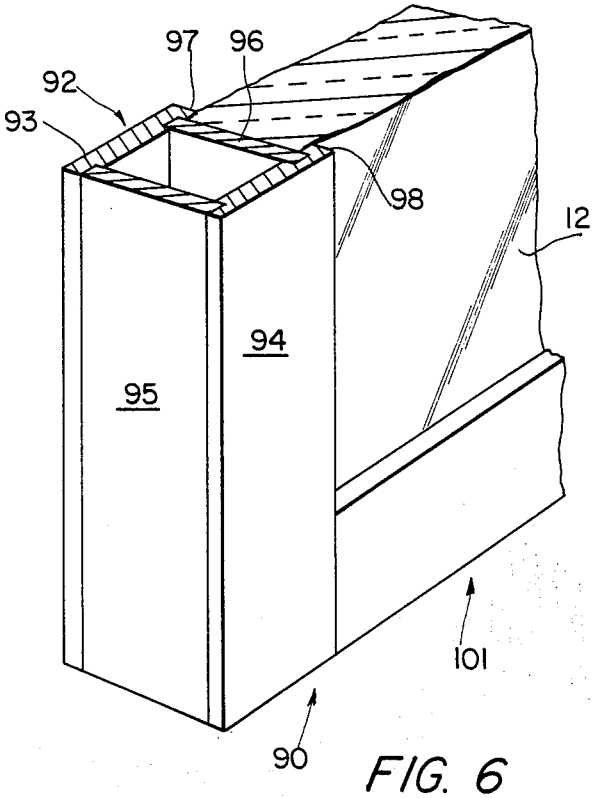
FIG. 6 is a perspective view of a corner element forming a component of a further embodiment of a glass block wall in accordance with the present invention.
Figure 7:
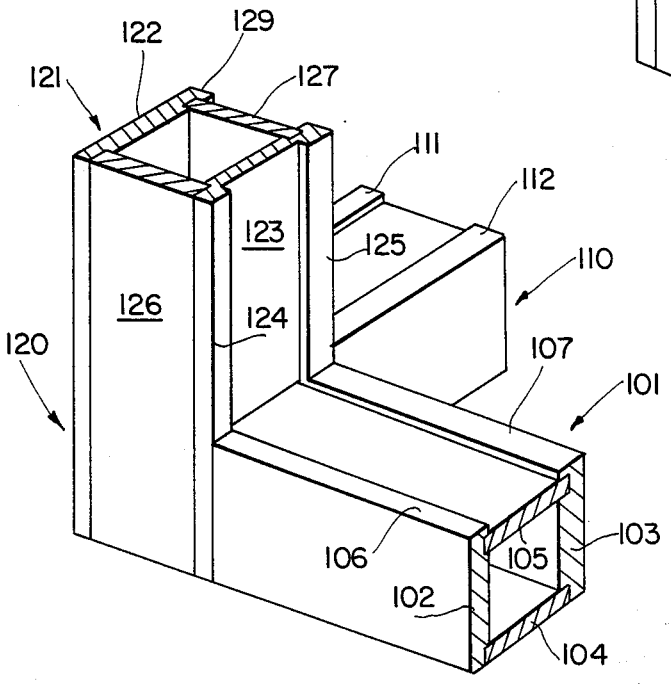
FIG. 7 is a perspective view of still another corner element, for forming two perpendicular glass block walls in accordance with the present invention.

In FIG. 6, there is shown a corner element 90 which includes a hollow vertical side column 92 comprising opposed side plates 93 and 94. A back wall 95 extends between the side plates 93 and 94 and a front wall 96 also extends between them, but spaced inwardly from the edges to provide flanges 97 and 98, respectively, to receive between them an adjoining glass block 12, face 14 and parts of marginal portion 14' thereof being shown. Forming a part of the corner element 90 is a horizontal beam 101 and as shown in FIG. 7, the horizontal beam 101 is constructed in a manner similar to the column 92, having side plates 102 and 103, a bottom wall 104, and a top wall 105 which lies beneath the edges thereof and provides flanges 106 and 107, respectively, so as to provide flanges which receive the adjoining glass block 12 (not shown in FIG. 7.) Thus, the corner glass block 12 may be placed in position on the corner element 90, with the flanges of the walls 102 and 103 and the flanges of the walls 93 and 94 adjoining lower and a side marginal portions of the glass block 12.

There is shown in FIG. 7, a base corner element 120 which may be used at the intersection of two perpendicular glass block walls. Thus, there is provided a column 121 comprising a back wall 122, a side wall 123 which is configured so as to provide outstanding flanges 124 and 125. A third wall 126 extends between the back and side walls 122 and 123, and a fourth wall 127 also extends between the back and side walls 122 and 123, respectively, being positioned so as to provide flanges 128 and 129. A second base beam 110 is shown, extending perpendicular to the base beam 101 and to the column 121. Base beam 110 is substantially identical in construction to the base beam 101. Thereby, it has upstanding flanges 111 and 112, to receive in adjoining relationship a glass block (not shown), which glass block will also be in adjoining relationship to the flanges 128 and 129.

The corner elements 90 and 120 may be utilized in certain installations where it is not desirable to have a spacer, such as the spacer 68, and where it is desirable also to have the bottom row of glass blocks 12 at a higher elevation than can be obtained through the use of the bottom base strip 60. These corner elements may be utilized in locations where the floor and wall are in substantially perpendicular relationship, whereas the embodiments of the inventions shown in FIGS. 1–5 may be utilized where such relationship is not provided.

The claims and the specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. A wall made of glass blocks and of separator strips, being of substantial strength, and which can be readily erected and disassembled comprising:

a plurality of glass blocks, said glass blocks each being a unitary molded element, said blocks being of the same standard size, said glass blocks having two substantially parallel and square side faces and two side edges, a bottom edge and a top edge transverse to and extending between said side faces, said side faces having a marginal portion adjacent each of said edges, said edges being without means for gripping and preventing movement of said glass blocks with respect to said separator strips, the actual lengths of said edges varying, said wall comprising a plurality of horizontal rows of said glass blocks, said rows being in vertical array, horizontal separator strips between the glass blocks in one row and the glass blocks in the adjoining row, vertical separator strips, each said vertical separator strip extending between two said horizontal separator strips and being between adjoining glass blocks in each said row of glass blocks, said separator strips each comprising a linearly extending planar web having opposed planar surfaces and sides, and a linearly extending transverse flange at each said side, each said flange having coplanar inner surfaces each substantially perpendicular to a said opposed planar surface of said web, each of said side edges of each said glass block substantially engaging a said web of one of said vertical separator strips, said wall being without intervening adhesive means for bonding said glass blocks to said vertical and horizontal separator strips to freely permit said vertical separator strips to be positioned during construction to accommodate the actual size variances in the lengths of said edges of said blocks, and said inner surfaces of said flanges adjoining said marginal portions of said side faces of said glass blocks.

2. The wall of claim 1, said wall comprising in addition to said glass blocks and said separator strips, shim means for exerting a lateral force on said blocks and said vertical separator strips in at least one said horizontal row of glass blocks and separator strips.

3. The wall of claim 1, said vertical separator strips having a length not longer than the length of a said edge of a said glass block.

4. The wall of claim 1, wherein some of said glass blocks are in substantially vertical alignment and provide an edge of said wall, and at least one substantially vertical side strip extending along said glass blocks at said edge of said wall, said side strip having a web and a pair of flanges substantially perpendicular thereto, said flanges adjoining marginal portions of said side faces of said glass blocks at said edge of said wall.

5. The wall of claim 1, wherein flanges of said vertical separator strips substantially engage flanges of the horizontal separator strips.

6. The wall of claim 5, the webs of said vertical separator strips extending beyond the flanges of said vertical separator strips and between flanges of said horizontal separator strips.

7. A wall of glass blocks comprising:

a plurality of horizontal rows of glass blocks of the same standard size, said rows being in vertical array, horizontal separator strips of non-adhering solid material between the blocks of each said row and the blocks of the row thereabove, vertical separator strips of non-adhering solid material between adjacent blocks in each row of blocks, each said vertical separator strip extending between two said horizontal separator strips, said glass blocks having edges substantially free of means for gripping and preventing movement with respect to said non-adhering solid material, said glass blocks engaging said horizontal and vertical separator strips without intervening adhesive.

means in addition to said blocks and separator strips for exerting a lateral force on the blocks in at least one of said horizontal rows of glass blocks and on said vertical separator strips therebetween, whereby said wall may be constructed with lateral positioning of said blocks and said vertical separator strips and with the exertion of a lateral force on said blocks and vertical separator strips of a said row by said force exerting means.

8. The wall of glass blocks of claim 7, wherein said horizontal separator strips each comprise an elongate web having substantially horizontal planar and parallel opposed surfaces and sides along the length thereof, a vertical flange at each side of said web extending substantially above and below said web, each said flange having coplanar first and second planar inner surfaces respectively substantially perpendicular to said opposed surfaces of said web, each said glass block having spaced apart vertical side faces and transverse edges, said side faces having marginal portions adjacent said edges, each said glass block resting on a said horizontal surface of a said web and being between a pair of opposed inner surfaces of said flanges, and means for holding said glass blocks securely against movement without bonding material comprising said opposed inner surfaces of said flanges adjoining a said marginal portion of the side faces of each said block.

9. The wall of glass blocks of claim 8, wherein said vertical separator strips each comprises:

an elongate web having substantially vertical planar and parallel opposed surfaces and sides along the length thereof, a transverse vertical flange at each of said sides of said web, each said flange having coplanar first and second inner surfaces respectively substantially perpendicular to said opposed surfaces of said web, said holding means further comprising said inner surfaces of said flanges of said second separator strips adjoining a said marginal portion of the side faces of each said glass block.

10. The wall of glass blocks of claim 9, wherein said webs of said vertical separator strips having end portions extending between the flanges of said horizontal separator strips.

* * * * *